US011549782B2

(12) United States Patent
Gallup et al.

(10) Patent No.: US 11,549,782 B2
(45) Date of Patent: Jan. 10, 2023

(54) HOLSTER WITH BENDABLE STRAP

(71) Applicants: Eric Gallup, Rochester Hills, MI (US); Zachary Oras, Riverview, FL (US); Michael Wargo, Sanford, FL (US)

(72) Inventors: Eric Gallup, Rochester Hills, MI (US); Zachary Oras, Riverview, FL (US); Michael Wargo, Sanford, FL (US)

(73) Assignee: Tech Dek Products LLC, Rochester Hills, MI (US)

( * ) Notice: Subject to any disclaimer, the term of this patent is extended or adjusted under 35 U.S.C. 154(b) by 0 days.

(21) Appl. No.: 17/093,584

(22) Filed: Nov. 9, 2020

(65) Prior Publication Data

US 2021/0207923 A1 Jul. 8, 2021

Related U.S. Application Data

(60) Provisional application No. 62/932,852, filed on Nov. 8, 2019.

(51) Int. Cl.

| | |
|---|---|
| ***A45F 5/02*** | (2006.01) |
| ***F41C 33/04*** | (2006.01) |
| ***F41C 33/02*** | (2006.01) |

(52) U.S. Cl.

CPC ..... *F41C 33/045* (2013.01); *F41C 33/0209* (2013.01); *A45F 5/021* (2013.01); *A45F 2200/0591* (2013.01)

(58) Field of Classification Search

CPC .. F41C 33/045; F41C 33/0209; F41C 33/041; F41C 33/008; F41C 33/00; F41C 33/046; F41C 33/006; A45F 5/02; A45F 5/021; A45F 2200/0591; A45C 13/30

See application file for complete search history.

(56) References Cited

U.S. PATENT DOCUMENTS

| | | | | |
|---|---|---|---|---|
| 4,483,501 | A * | 11/1984 | Eddy | F41C 33/0209 224/198 |
| 4,940,204 | A | 7/1990 | Nelson et al. | |
| 5,509,632 | A | 4/1996 | Mesna et al. | |
| 5,853,212 | A | 12/1998 | Daniel | |
| 7,250,213 | B2 | 7/2007 | Duncan | |
| 7,600,513 | B2 | 10/2009 | Gunaratnam et al. | |
| 7,640,632 | B2 | 1/2010 | Lazarus | |
| 8,387,216 | B1 | 3/2013 | Martinson | |
| 8,979,060 | B1 | 3/2015 | Olsson et al. | |
| 10,856,642 | B1 * | 12/2020 | Spell | A45F 5/02 |
| 2001/0049863 | A1 * | 12/2001 | Ogino | A41F 11/06 24/265 EC |
| 2004/0029623 | A1 | 2/2004 | Ellis et al. | |
| 2007/0006426 | A1 | 1/2007 | Fukuyasu et al. | |
| 2007/0261978 | A1 | 11/2007 | Sanderson | |

(Continued)

FOREIGN PATENT DOCUMENTS

GB 2477102 A 7/2011

*Primary Examiner* — Corey N Skurdal

(74) *Attorney, Agent, or Firm* — Carlson, Gaskey & Olds, P.C.

(57) ABSTRACT

An assembly for holding an item includes a bendable strap. A base plate is secured at one end of the bendable strap. The base plate includes a plurality of openings therethrough. Each of the openings has a larger diameter portion and a smaller diameter portion. A clip is secured to the openings in the base plate. A holster or other item may be secured to the clip.

23 Claims, 7 Drawing Sheets

(56) References Cited

U.S. PATENT DOCUMENTS

| | | | | |
|---|---|---|---|---|
| 2009/0084705 | A1 | 4/2009 | Justiss | |
| 2011/0252607 | A1 | 10/2011 | Rothbaum et al. | |
| 2012/0080440 | A1 | 4/2012 | McClees | |
| 2012/0198680 | A1 | 8/2012 | Durben et al. | |
| 2012/0235001 | A1 | 9/2012 | Somuah | |
| 2013/0306689 | A1 | 11/2013 | Johnson | |
| 2015/0129724 | A1 | 5/2015 | Kohmoto et al. | |
| 2015/0192388 | A1* | 7/2015 | Blach | F41C 33/041 224/660 |
| 2016/0007735 | A1* | 1/2016 | Gallup | A47G 1/16 248/447.1 |
| 2018/0325248 | A1* | 11/2018 | Tedder | F41C 33/041 |
| 2019/0298039 | A1* | 10/2019 | Tedder | A45F 3/14 |

* cited by examiner

HOLSTER WITH BENDABLE STRAP

BACKGROUND AND SUMMARY

Retention of a handgun in a safe but accessible location is often difficult. Sometimes a handgun is not able to be carried in a holster on a user's belt but should still be accessible. It is still preferred that the handgun be in the holster, i.e. with the trigger covered. The assembly provided herein permits a handgun to be retained in any holster (including custom holsters) and secured in a variety of locations.

An assembly for holding an item such as a handgun holster includes a bendable strap. A base plate is secured at one end of the bendable strap. The base plate includes a plurality of openings therethrough. Each of the openings has a larger diameter portion and a smaller diameter portion. A clip is secured to the openings in the base plate. The holster or other item may be secured to the clip in the same way that it secures to a belt.

BRIEF DESCRIPTION OF THE DRAWINGS

FIG. 3 is a partially exploded view, partially broken away of the bendable strap of FIG. 2.

DETAILED DESCRIPTION

Figure 1:
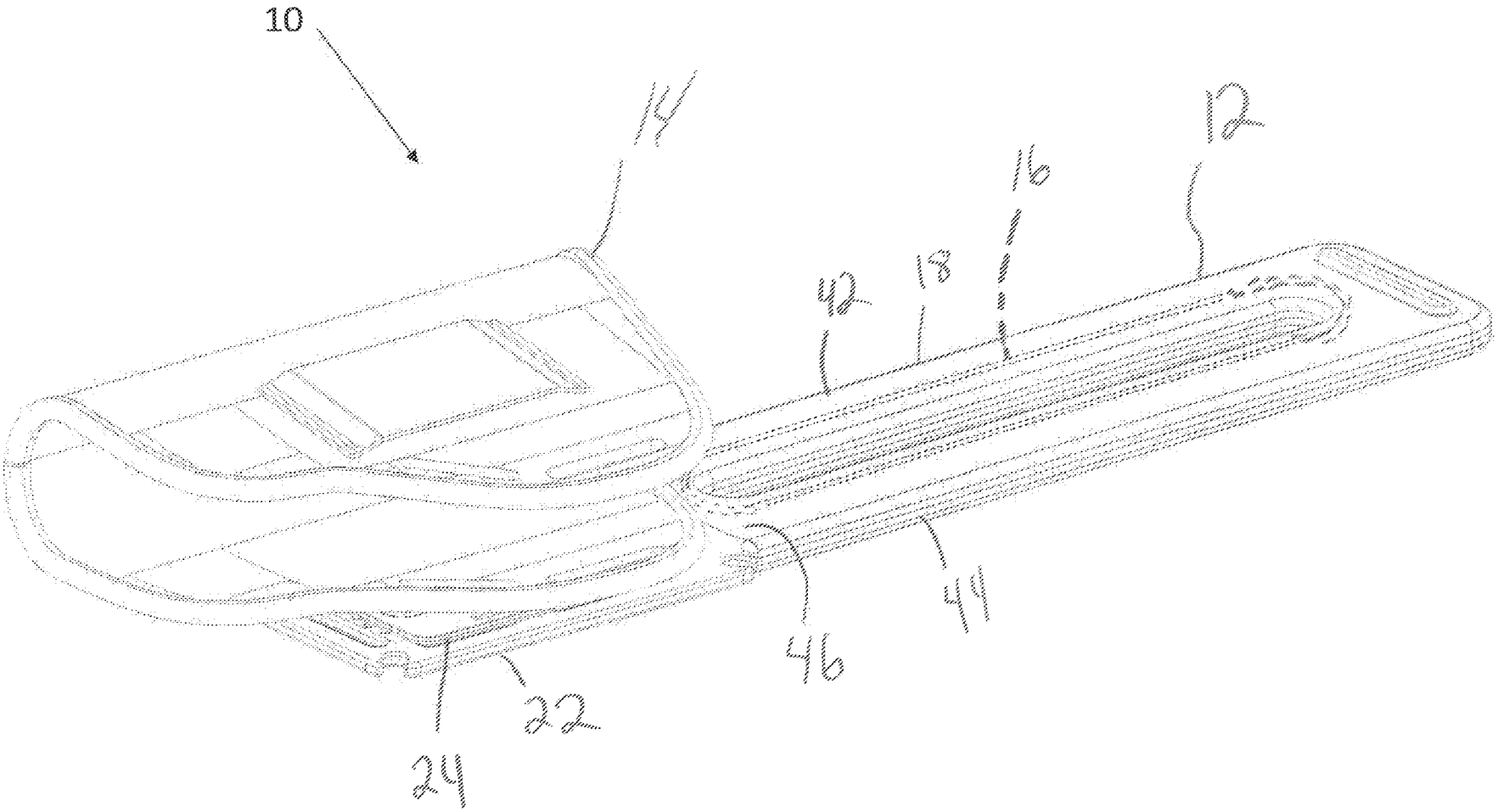
FIG. 1 is a perspective view of a holster assembly according to one embodiment.

FIG. 1 illustrates an assembly 10 according to a first embodiment for holding a handgun. The assembly 10 includes a bendable strap 12 and holster 14 for retaining a handgun. The bendable strap 12 includes a plastically deformable support member 16 disposed within a resilient, flexible body 18. The bendable strap 12 includes a first leg 42 and a second leg 44, each extending from a base portion 46. The base portion 46 of the bendable strap 12 is connected to the holster 14.

The base portion 46 of the bendable strap 12 is connected to a base plate 22. The bendable strap 12 may be permanently connected to the base plate 22 (such as by insert molding) or may be removably connected, such as by a latch as explained further below. A clip 24 is secured to the base plate 22 and the holster 14 is secured to the clip 24.

The holster 14 can be any available handgun holster, but as will be explained, in the configuration shown, the holster 14 is of the type capable of being secured to a belt on a carrier's waist.

Figure 2:
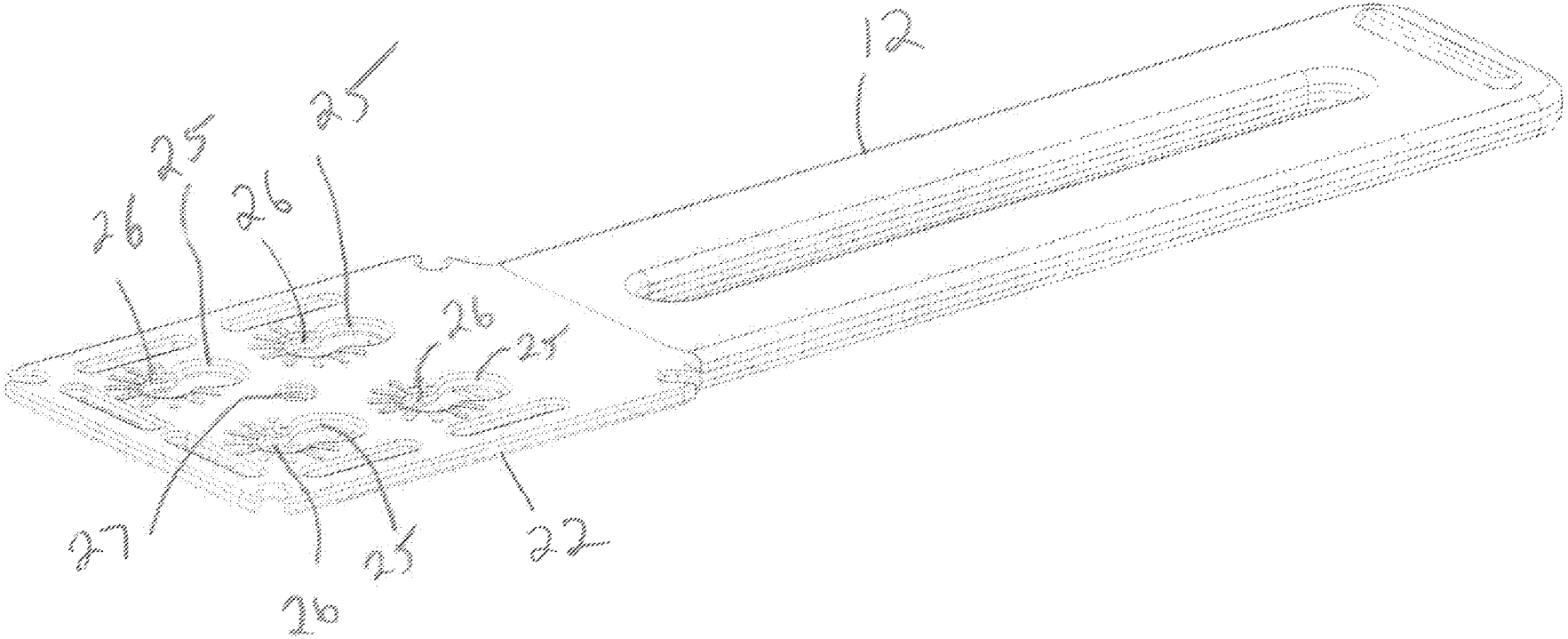
FIG. 2 shows the bendable strap and base plate of the holster assembly of FIG. 1.

FIG. 2 shows the bendable strap 12 and base plate 22. The base plate 22 may be hard plastic or metal and has a plurality of openings therethrough (in this example, four), each having a larger diameter portion 25 contiguous with a smaller diameter portion 26. The base plate 22 further includes an aperture 27, which may be threaded.

Figures 2, 4:
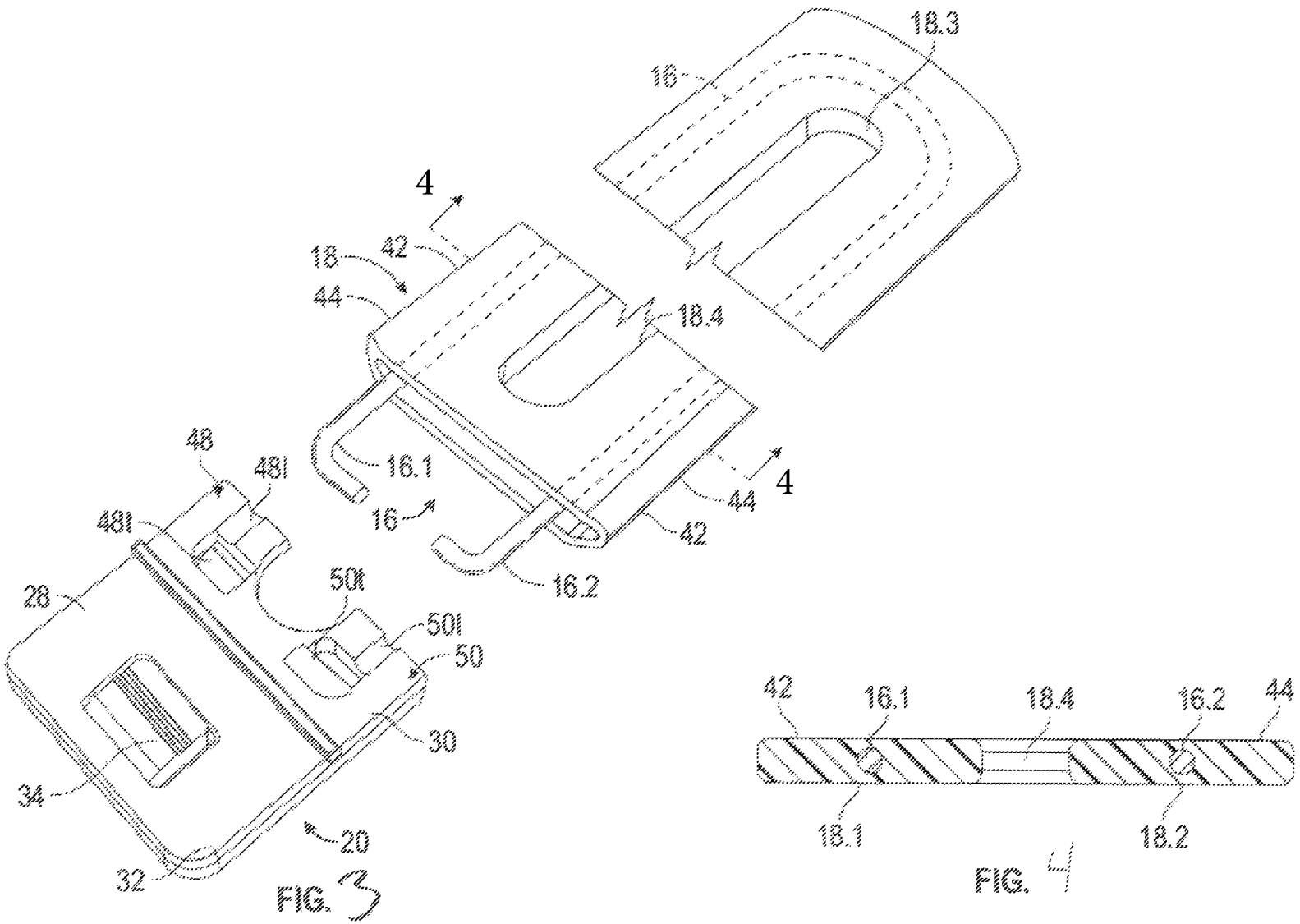
FIG. 4 is a section view taken along line 4-4 through the bendable strap of FIG. 3.

With reference now to FIGS. 3 and 4, the bendable strap 12 includes a deformable support member 16 in the form of a flexible, ductile wire or metal strip which can be plastically deformed by hand and will retain its new position. As presently preferred, the support member 16 is formed as a U-shaped member with a pair of legs 16.1, 16.2. A flexible body 18 covers the support member 16 to provide a relatively thin, generally rectangular structure. The flexible body 18 may be a polymer or may be a foam rubber. The support member 16 is deformable to a new shape and will keep its new shape, including keeping the flexible body 18 in the new shape. The bendable strap 12, and in particular the deformable support member 16, is secured to a first coupling element 20.

A first end 30 of tongue plate 28 has a pair of channels 48, 50 formed therein. As can be seen in FIG. 3, the channels 48, 50 have a longitudinal portion **48*l*, 50*l* and a transverse portion 48*t*, 50*t*. The ends of legs 16.1, 16.2 may be bent inward to provide a locking mechanical connection between the bendable strap 12 and the first coupling element 20. As presently preferred, the flexible body 18 is formed over the first end 30 of tongue plate 28 (FIG. 3) further securing the bendable strap 12 to the first coupling element 20. For example, the first end 30 of the tongue plate 28 may be insert-molded in the flexible body 18**.

The deformable support member 16 includes the pair of legs 16.1, 16.2. In a preferred embodiment, the flexible body 18 has a first body portion 18.1 covering a first leg 16.1 and a second body portion 18.2 covering a second leg 16.2. The flexible body 18 further includes an end portion 18.3 interconnecting the first and second body portions 18.1, 18.2 and covering the end of the U-shaped deformable support member 16. The flexible body 18 defines a slot 18.4 between the first and second body portions 18.1, 18.2. In this configuration, the bendable strap 12 can be hung on a support structure. The first coupling element 20 includes a latch 34 that can be snap-fit into an opening (not shown) in the base plate 22 (FIG. 2).

Figure 5:
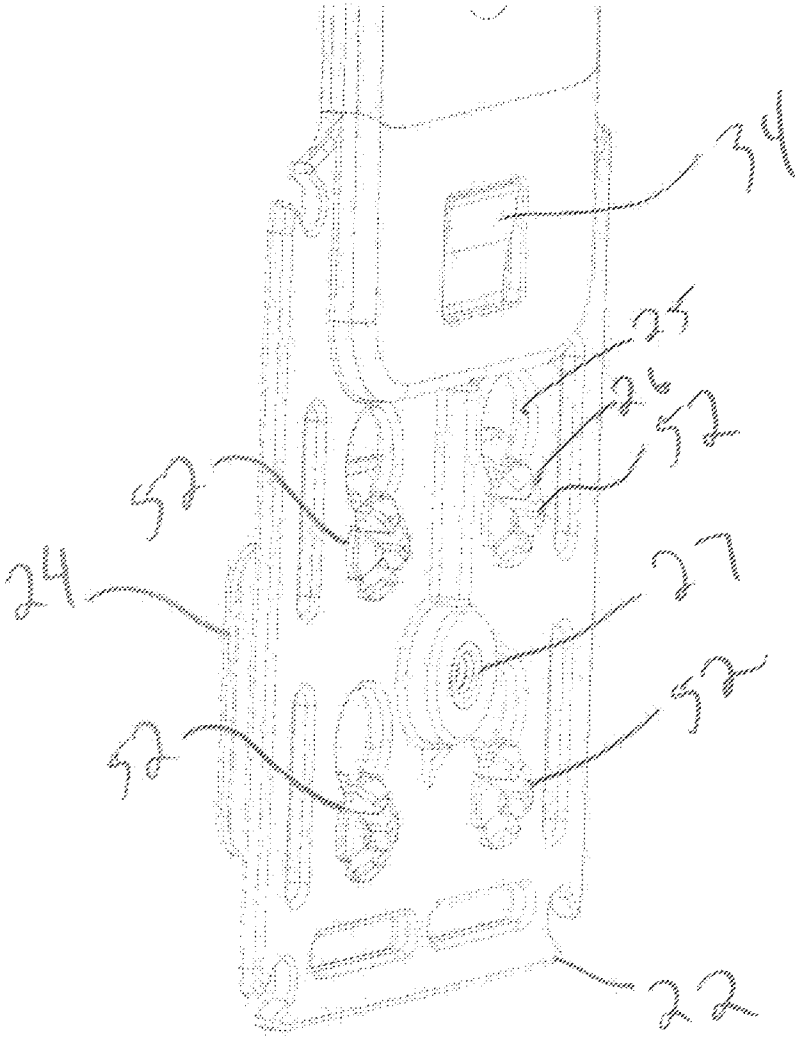
FIG. 5 is a rear view of the clip secured to the base plate of FIG. 2.
Figure 6:
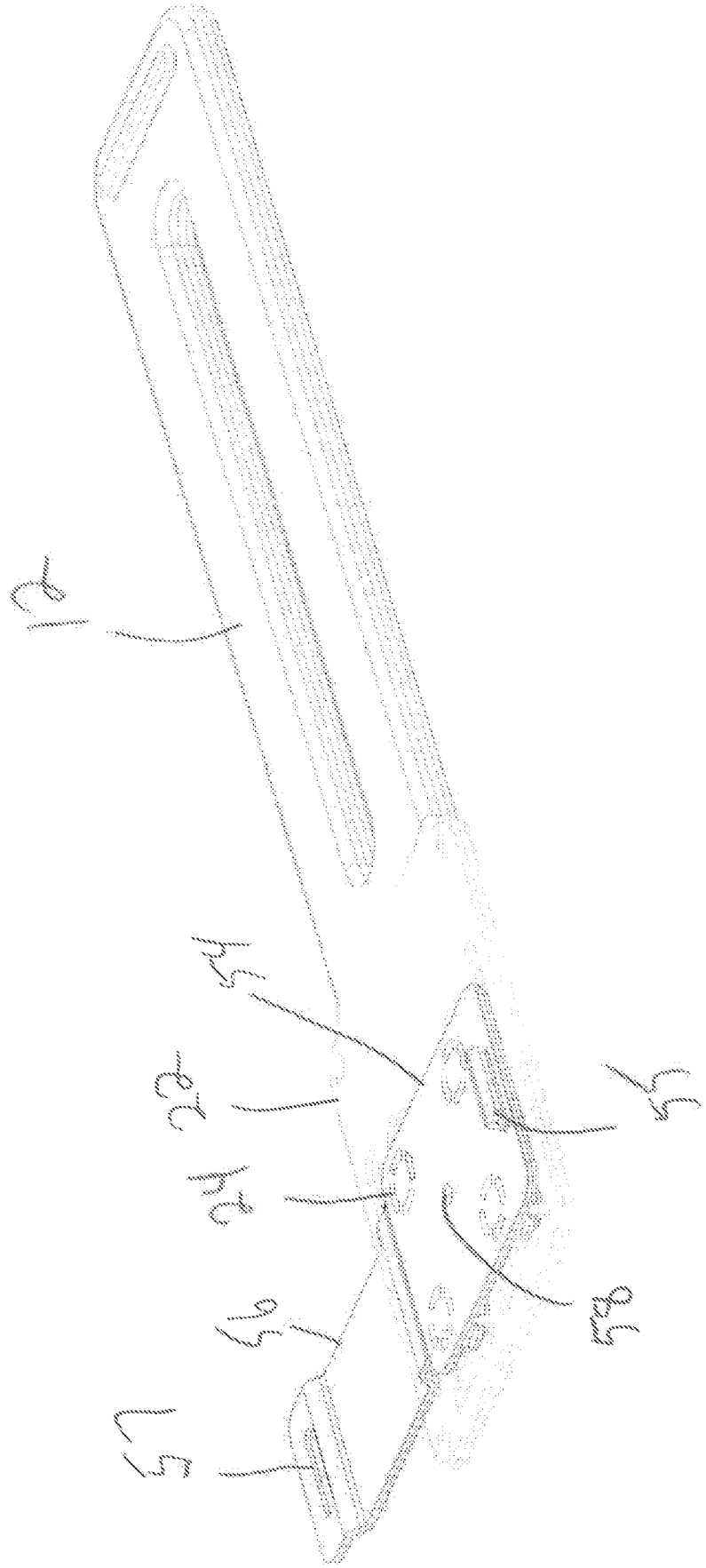
FIG. 6 is a front perspective view of the clip and base plate with the clip open.

FIGS. 5 and 6 show the clip 24 secured to the base plate 22. Referring to FIG. 5, the clip 24 includes a plurality of integrally-formed studs 52 having enlarged outer ends. The studs 52 can be inserted through the larger diameter portions 25 through the base plate 22 and slid into the smaller diameter portions 26, where they are retained because the enlarged outer ends of the studs 52 are larger than the smaller diameter portions 26 of the openings through the base plate 22. Also shown in FIG. 5, the latch 34 of the tongue plate 28 is received in an opening through an inner wall of the base plate 22 to secure the bendable strap 12 to the base plate 22.

In FIG. 6, the clip 24 is shown in the open position. The clip 24 includes a base portion 54 having a first latch member 55 and a cover portion 56 having a complementary second latch member 57. Each of the base portion 54 and the cover portion 56 can be hard plastic or metal. Alternatively, the base portion 54 and cover portion 56 could be formed integrally, such as with a living hinge. The cover portion 56 may be hingeably connected to the base portion 54 and selectively securable in the closed position by the first latch member 55 and second latch member 57. Alternatively, the cover portion 56 may be formed integrally with the base portion 54 with the cover portion 56 permanently in the closed position. An aperture 58 through the base portion 54 permits the clip 24 to be further secured to the base plate 22 by a screw (not shown) into the aperture 27 (FIG. 2) of the base plate 22.

Figure 7:
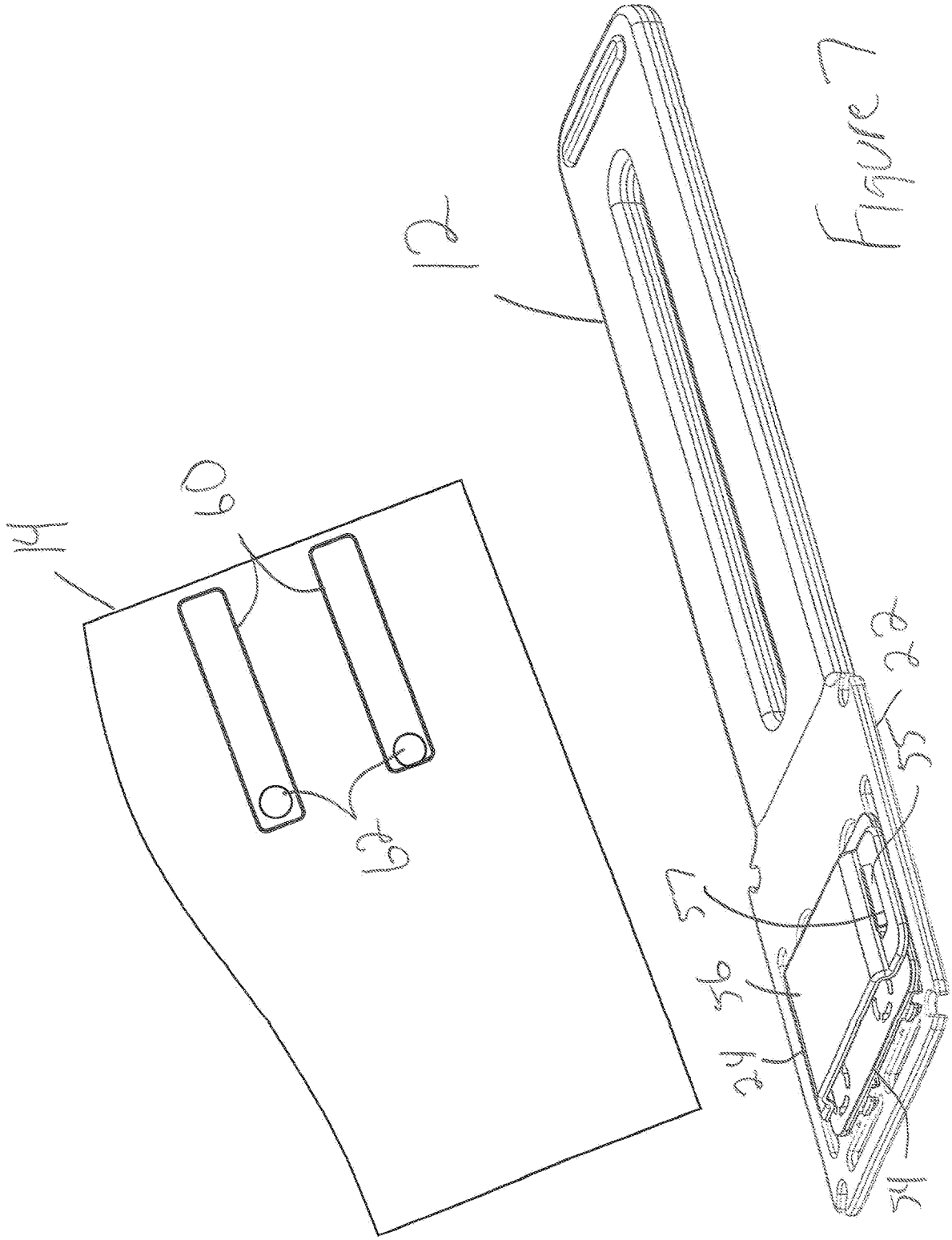
FIG. 7 shows the clip and base plate of FIG. 6 with the clip closed and the holster removed from the clip.

FIG. 7 shows the bendable strap 12, base plate 22 and clip 24, with the clip 24 in the closed position. In this position, the cover portion 56 is spaced away from the base portion 54 sufficiently to receive one or more loops 60 or clips of the holster 14. The holster 14 (or any holster configured to secure to a belt for a user's waist) has loops 60 or clips that can be secured to the cover portion 56, optionally via snaps 62, in the same way that the holster would be secured to a belt.

Figure 8:
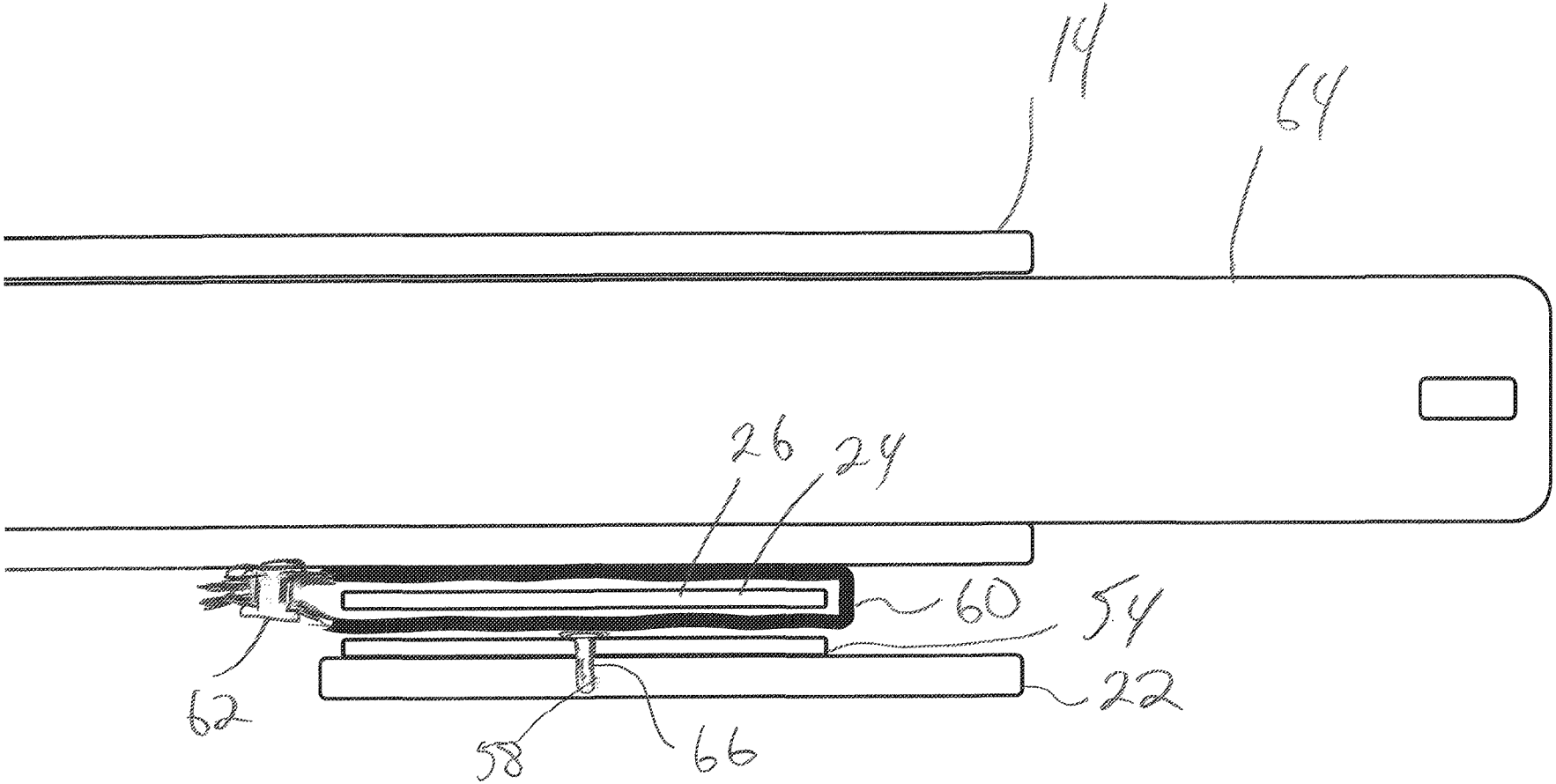
FIG. 8 is a section view through the assembly, including the handgun in the holster.

FIG. 8 is a section view through the assembly 10 with a handgun 64 received in the holster 14. The holster 14 is secured to loops 60 (one shown) that are received within the clip 24 between the cover 26 and base 54. The base 54 of the clip is secured to the base plate 22 as described above and with the optional screw 66 threaded into the aperture 58 in the base plate 22.

Referring again to FIG. 1, the assembly 10 permits a user to mount a holster 14 in a variety of locations, such to the user's bed, next to the bed, or in the user's vehicle. The bendable strap 12 can be plastically deformed to further secure the strap 12 to some solid structure. The assembly 10 could also be secured to items other than holsters, particularly other items that are already configured to be secured to a belt.

In accordance with the provisions of the patent statutes and jurisprudence, exemplary configurations described above are considered to represent preferred embodiments of the inventions. However, it should be noted that the inventions can be practiced otherwise than as specifically illustrated and described without departing from its spirit or scope. Alphanumeric identifiers on method steps are solely for ease in reference in dependent claims and such identifiers by themselves do not signify a required sequence of performance, unless otherwise explicitly specified.

What is claimed is:

1. An assembly for holding an item comprising:

a bendable strap; and a generally planar base plate at one end of the bendable strap, wherein the base plate includes a plurality of openings extending perpendicularly therethrough and arranged in a 2×2 array, each of the openings having a larger diameter portion and a smaller diameter portion.

2. The assembly of claim 1 wherein the bendable strap includes a plastically deformable support member disposed within a resilient flexible body.

3. The assembly of claim 1 wherein the bendable strap is U-shaped having a pair of spaced-apart, parallel legs.

4. The assembly of claim 3 wherein the base plate includes a threaded aperture formed therein.

5. An assembly for holding an item comprising:

a bendable strap;

a base plate at one end of the bendable strap, wherein the base plate includes a plurality of openings therethrough, each of the openings having a larger diameter portion and a smaller diameter portion; and a clip secured to the base plate, the clip including a base portion secured to the base plate and a cover portion hingeably secured to the base portion.

6. An assembly for holding an item comprising:

a bendable strap including a plastically deformable support member disposed within a resilient flexible body;

a generally planar base plate at one end of the bendable strap, wherein the base plate includes a plurality of openings extending perpendicularly therethrough, each of the openings having a larger diameter portion and a smaller diameter portion; and a clip secured to the base plate, the clip including a base portion and a cover portion parallel to and spaced away from the base portion, the base portion secured to the base plate.

7. The assembly of claim 6 further including a holster secured to the clip.

8. The assembly of claim 7 further including a handgun received in the holster.

9. The assembly of claim 7 wherein the base plate further includes a threaded aperture therein.

10. The assembly of claim 9 wherein the bendable strap includes a first leg and a second leg extending in parallel from the base plate, the bendable strap further including an end portion connecting outer ends of the first leg and the second leg.

11. The assembly of claim 10 further including a handgun received in the holster.

12. The assembly of claim 11 wherein the base portion of the clip is secured to the base plate by a screw.

13. The assembly of claim 12 further including a plurality of studs secured to the base portion of the clip, wherein the studs each have an outer end having a diameter larger than the smaller diameter portion of one of the plurality of openings in the base plate in which the each stud is received.

14. An assembly for holding an item comprising:

a bendable strap;

a generally planar base plate at one end of the bendable strap; and a clip having a cover portion hingeably secured to a base portion, the base portion secured to the base plate wherein a major surface of the base portion abuts a major surface of the base plate, a latch selectively securing the cover portion to the base portion.

15. The assembly of claim 14 wherein the bendable strap includes a plastically deformable support member disposed within a resilient flexible body.

16. The assembly of claim 15 wherein the cover portion is parallel to and spaced away from the base portion.

17. The assembly of claim 14 wherein the base plate includes a plurality of openings extending perpendicularly through the base plate, each of the openings having a larger diameter portion and a smaller diameter portion.

18. The assembly of claim 17 wherein the bendable strap is U-shaped having a pair of spaced-apart, parallel legs.

19. An assembly for holding an item comprising:

a bendable strap including a plastically deformable support member disposed within a resilient flexible body;

a base plate at one end of the bendable strap; and a clip having a cover portion hingeably secured to a base portion, the base portion secured to the base plate, a latch selectively securing the cover portion to the base portion, wherein the cover portion is parallel to and spaced away from the base portion; and a holster secured to the clip.

20. The assembly of claim 19 further including a handgun received in the holster.

21. The assembly of claim 20 wherein the bendable strap includes a first leg and a second leg extending in parallel from the base plate, the bendable strap further including an end portion connecting outer ends of the first leg and the second leg.

22. An assembly for holding an item comprising:

a bendable strap;

a generally planar base plate at one end of the bendable strap, wherein the base plate includes a plurality of openings extending perpendicularly therethrough, each of the openings having a larger diameter portion and a smaller diameter portion; and a stud having an outer end having a diameter larger than the smaller diameter portion of one of the plurality of openings in the base plate, and wherein the outer end of the stud is insertable through the larger diameter portion of one of the plurality of openings and the stud is slidable into the associated smaller diameter portion of the one of the plurality of openings to secure the stud to the base plate.

23. The assembly of claim 22 wherein the plurality of openings includes four openings arranged in a 2×2 array on the base plate.

* * * * *